US006553783B2

(12) United States Patent
Dobson et al.

(10) Patent No.: US 6,553,783 B2
(45) Date of Patent: Apr. 29, 2003

(54) INTEGRATED U-TUBE AND ADSORBENT UNIT

(75) Inventors: Rodney L. Dobson, Greer, SC (US); Samuel A. Incorvia, North Tonawanda, NY (US); Peter R. Millen, Perry, NY (US)

(73) Assignee: Multisorb Technologies, Inc., Buffalo, NY (US)

( * ) Notice: Subject to any disclaimer, the term of this patent is extended or adjusted under 35 U.S.C. 154(b) by 0 days.

(21) Appl. No.: 10/206,695

(22) Filed: Jul. 26, 2002

(65) Prior Publication Data

US 2002/0184911 A1 Dec. 12, 2002

Related U.S. Application Data

(63) Continuation of application No. 09/698,531, filed on Oct. 27, 2000, now Pat. No. 6,438,991, which is a continuation-in-part of application No. 09/603,415, filed on Jun. 26, 2000, now Pat. No. 6,301,924.

(51) Int. Cl.[7] ..... F25B 43/04

(52) U.S. Cl. ..... 62/475; 62/503; 62/472

(58) Field of Search ..... 62/475, 472, 503, 62/125; 96/147; 210/282; 206/204

(56) References Cited

U.S. PATENT DOCUMENTS

| | | | | |
|---|---|---|---|---|
| 4,619,673 | A | 10/1986 | Cullen et al. | |
| 4,994,185 | A | 2/1991 | Cullen et al. | |
| 5,036,972 | A | 8/1991 | Cullen et al. | |
| 5,119,616 | A | 6/1992 | Cullen et al. | |
| 5,570,589 | A | 11/1996 | Petty | |
| 5,987,915 | A | 11/1999 | Incorvia et al. | |
| 6,209,347 | B1 | 4/2001 | Corrigan et al. | |
| 6,301,924 | B1 | 10/2001 | Dobson et al. | |
| 6,438,991 | B1 * | 8/2002 | Dobson et al. | 62/475 |

* cited by examiner

*Primary Examiner*—Denise L. Esquivel
*Assistant Examiner*—Melvin Jones
(74) *Attorney, Agent, or Firm*—Joseph P. Gastel

(57) ABSTRACT

An integrated U-tube and adsorbent unit including a U-tube having first and second legs and a return bend, a space between the first and second legs and the return bend, adsorbent in the space, opposite sides on the first and second legs and the return bend, permeable covers bonded to the first and second opposite sides to contain the adsorbent within the space, a hole in the return bend, a frame connected to the U-bend and defining a space in communication with the hole, and filter material on the frame. An integrated U-tube and adsorbent unit including a plastic U-tube and a self-contained adsorbent unit having a plastic cover bonded to the U-tube with the body of the self-contained adsorbent unit positioned between the legs of the U-tube.

6 Claims, 7 Drawing Sheets

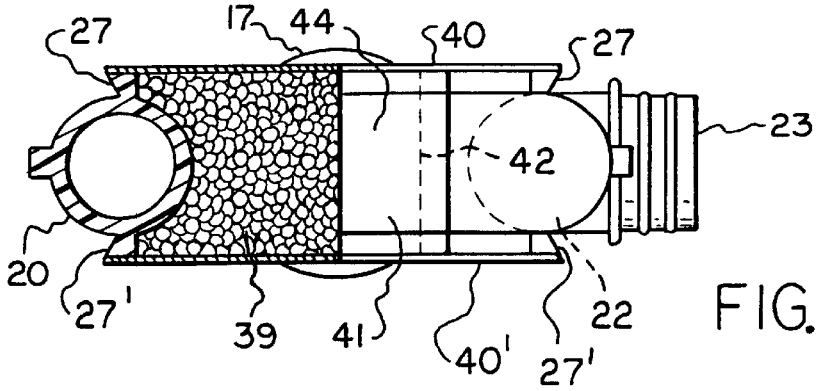
FIG. 3
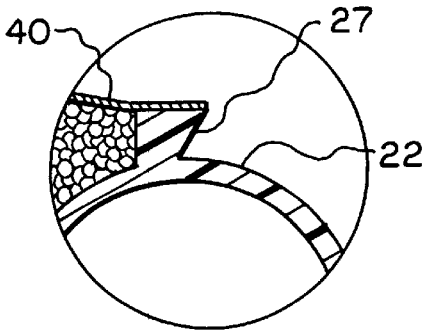
FIG. 4
FIG. 5
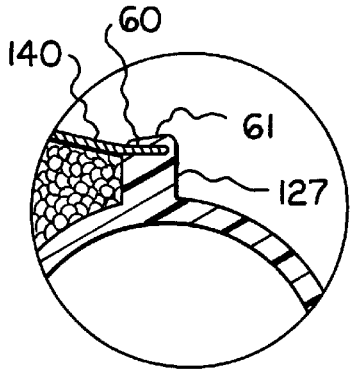
FIG. 7
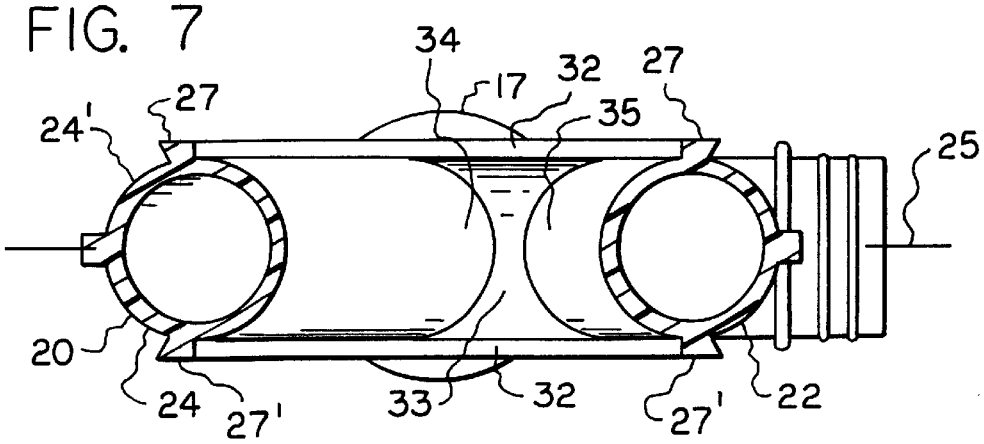

FIG. 17
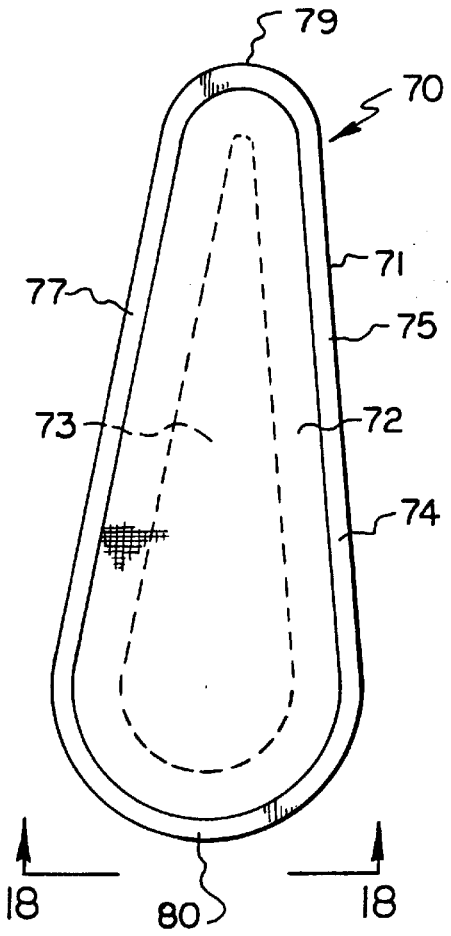
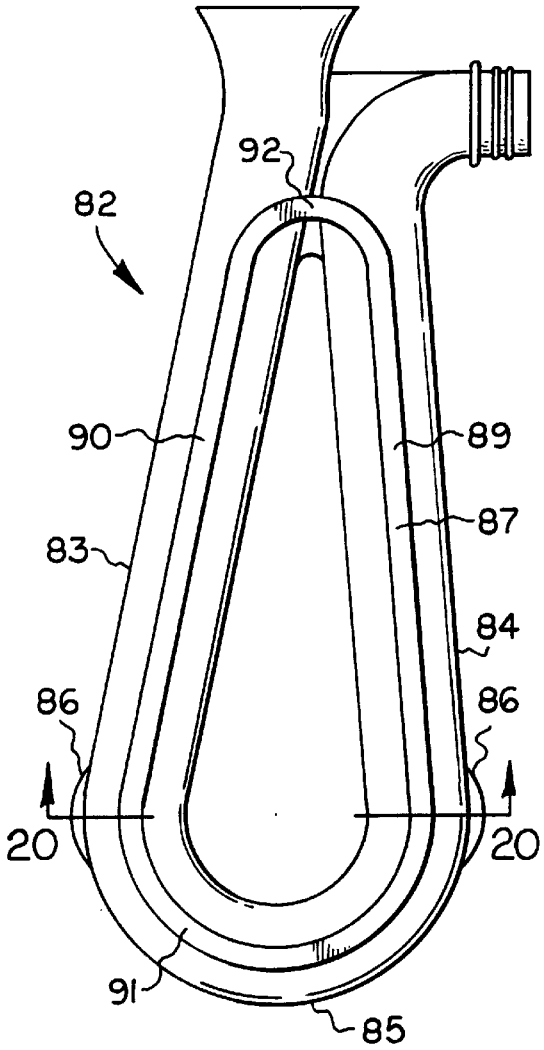
FIG. 19
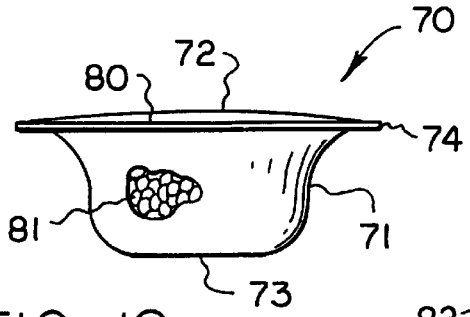
FIG. 18
FIG. 20
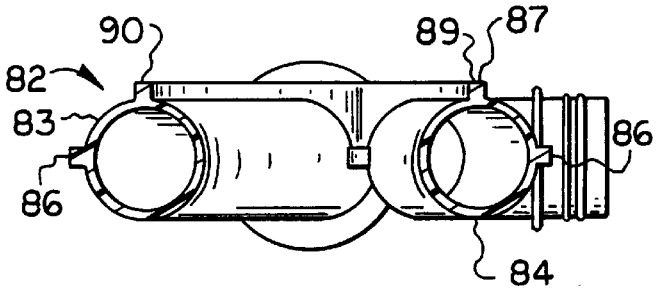

INTEGRATED U-TUBE AND ADSORBENT UNIT

CROSS-REFERENCE TO RELATED APPLICATIONS

The present application is a continuation of application Ser. No. 09/698,531, filed Oct. 27, 200, now U.S. Pat. No. 6,438,991, which is a continuation-in-part of application Ser. No. 09/603,415, filed Jun. 26, 2000, now U.S. Pat. No. 6,301,924.

STATEMENT REGARDING FEDERALLY SPONSORED RESEARCH OR DEVELOPMENT

Not Applicable

BACKGROUND OF THE INVENTION

The present invention relates to an integrated U-tube and adsorbent unit for an accumulator of an automotive air conditioning system.

By way of background, insofar as known, in the past a refrigerant accumulator used in an automotive air conditioning system comprised a housing which contained a U-tube and a separate adsorbent unit associated therewith. The adsorbent unit, in the past, could have been of various shapes and sizes and could have been secured to the U-tube in many different ways. However, insofar as known, the prior art did not disclose an integrated U-tube and adsorbent unit wherein the adsorbent unit was an integral part of the U-tube. Also, insofar as known, in the past a separate filter construction was mounted on the return bend of a U-tube to filter the oil which was induced into the return bend. The addition of such a filter construction added costs which resulted from the additional material and labor. Also, insofar as known, in the past refrigerant tracer dye was generally placed directly in the adsorbent unit of an accumulator of an automotive air conditioning system.

BRIEF SUMMARY OF THE INVENTION

It is the primary object of the present invention to provide an integrated U-tube and adsorbent unit wherein the adsorbent unit is an integral and inseparable part of the U-tube.

Another object of the present invention is to provide an integrated U-tube and adsorbent unit which can be fabricated by a simple fabrication technique wherein the space between the legs of the U-tube contains adsorbent which is restricted therein by covers bonded to the outer sides of the U-tube.

Another object of the present invention is to provide an integrated U-tube and adsorbent unit which does not require the assembly of a separate U-tube and adsorbent unit after they are individually fabricated incidental to installing them in the housing of an accumulator.

A further object is to provide an improved method of fabricating a U-tube having an integral adsorbent unit.

A still further object of the present invention is to provide an improved U-tube having an unique filter construction.

Yet another object of the present invention is to provide an improved U-tube construction which includes a separate compartment which contains refrigerant tracer dye. Other objects and attendant advantages of the present invention will readily be perceived hereafter.

The present invention relates to an integrated U-tube and adsorbent unit comprising a U-tube having first and second legs and a return bend, a space between said first and second legs, adsorbent in said space, and at least one permeable cover bonded to said legs.

The present invention also relates to an integrated U-tube and adsorbent unit comprising a plastic U-tube having first and second plastic legs and a plastic return bend, a plastic cover, adsorbent confined by said plastic cover, and said plastic cover being fused to said plastic U-tube.

The present invention also relates to a method of fabricating an integrated U-tube and adsorbent unit comprising the steps of providing a U-tube having legs and a return bend with a space between said legs and first and second opposite sides on said legs, providing a first cover on said first sides of said legs, placing adsorbent between said legs, and bonding a second cover to said second sides of said legs.

The present invention also relates to a U-tube comprising spaced legs and a return bend, an oil pick-up hole in said return bend, a frame formed integrally with said return bend to define a space in communication with said hole, and filter material bonded to said frame on the opposite side of said space from said hole.

The present invention also relates to a refrigerant tracer dye construction comprising a tube, and a refrigerant tracer dye compartment on said tube.

The various aspects of the present invention will be more fully understood when the following portions of the specification are read in conjunction with the accompanying drawings wherein:

BRIEF DESCRIPTION OF THE SEVERAL VIEWS OF THE DRAWING

FIG. 3 is a cross sectional view taken substantially along line 3—3 of FIG. 1;

FIG. 4 is an enlarged fragmentary detail view showing the permeable cover bonded to a ridge on the U-tube and taken substantially along line 4—4 of FIG. 1 with certain parts omitted;

FIG. 5 is a view similar to FIG. 4 but showing a different type of bonded connection between the permeable cover and the ridge on the U-tube;

FIG. 7 is an enlarged cross sectional view taken substantially along line 7—7 of FIG. 6;

FIG. 17 is a side elevational view of an adsorbent unit which can be integrated onto a U-bend;

FIG. 18 is an end elevational view taken substantially in the direction of arrows 18—18 of FIG. 17;

FIG. 19 is a side elevational view of a U-tube onto which the adsorbent unit of FIGS. 17 and 18 can be integrated;

FIG. 20 is a cross sectional view taken substantially along line 20—20 of FIG. 19;

DETAILED DESCRIPTION OF THE INVENTION

Figure 2:
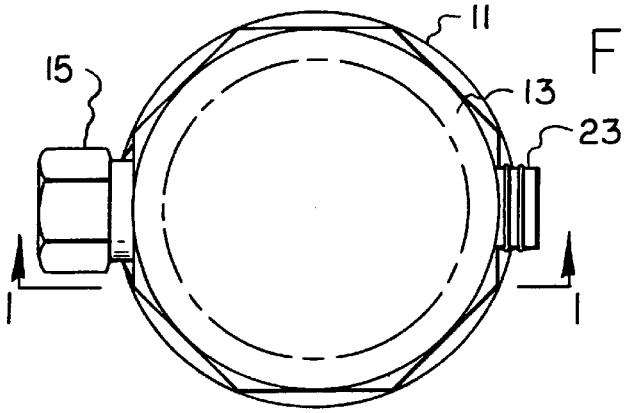
FIG. 2 is a plan view of the integrated U-tube and adsorbent unit taken substantially in the direction of arrows 2—2 of FIG. 1.

The integrated U-tube and adsorbent unit 10 of the present invention is shown mounted in an accumulator housing 11 which includes a substantially cylindrical bottom portion 12 which has welded thereto an upper portion 13 along annular weld 14. Upper portion 13 has integrally formed therewith an inlet tube 15 which conducts a mixture of refrigerant liquid and gas from an evaporator to the inside of the accumulator, with the liquid dropping to the bottom and the gaseous refrigerant rising to the top. The gaseous refrigerant will be induced into the open end 17 of U-tube 19 and will pass through leg 20, U-bend 21 and leg 22 to outlet conduit 23 which leads to the compressor. An oil-inlet hole or orifice 26 (FIG. 6) is located at the underside of U-bend 21 to entrain oil located at the bottom of the accumulator housing, and this oil is conveyed along with the gaseous refrigerant to the compressor. The foregoing type of operation is well known in the art. The basic U-tube 19 exclusive of the frame 41 on the return bend 21, exclusive of the housing for the refrigerant tracer dye and exclusive of the structure for mounting the covers on the sides of the U-tube is a prior art construction which has ears 18 which bear against the inside of container bottom portion 12.

Figure 6:
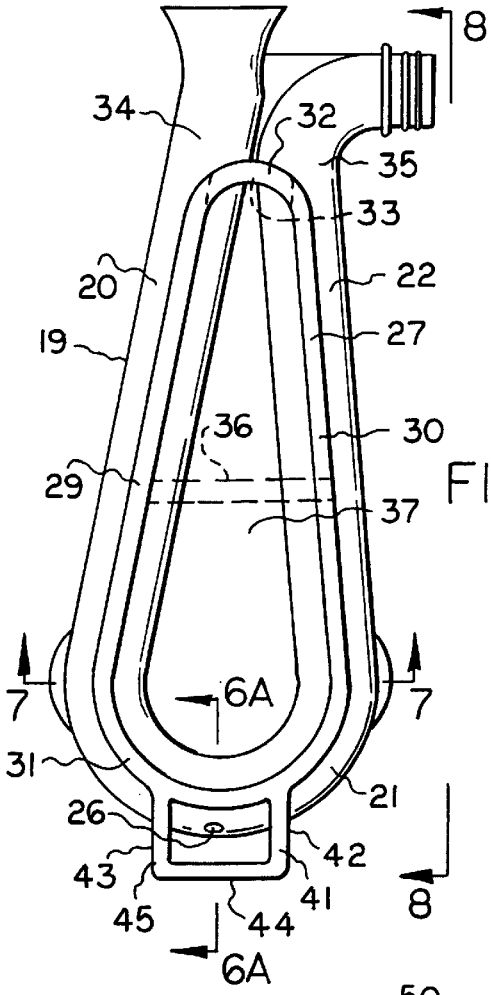
FIG. 6 is a side elevational view of the U-tube of FIGS. 1–4 and showing the ridge on the legs and return bend of the U-tube.
Figure 8:
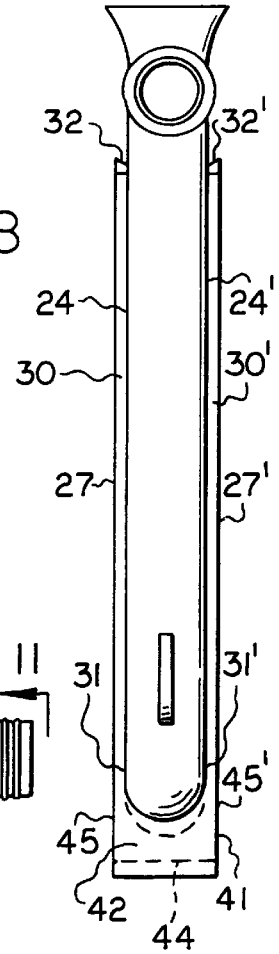
FIG. 8 is a side elevational view of the U-tube of FIG. 6 taken substantially in the direction of arrows 8—8 of FIG. 6.

The integrated U-tube and adsorbent unit 10 of the present invention includes the above described U-tube 19 having legs 20 and 22 connected by U-bend 21. It is fabricated of blow-molded polyethylene by conventional blow-molding fabrication techniques. It includes two opposite sides 24 and 24' which are essentially mirror image counter-parts about centerline 25 (FIG. 7). On one side of U-bend 19, a continuous ridge 27 is molded integrally with legs 20 and 22 and U-bend 21, as shown in FIG. 6. More specifically, the continuous ridge 27 includes sections 29 and 30 on legs 20 and 22, respectively, a connecting portion 31, which connects portions 29 and 30 and is located on U-bend 21, and a connecting portion 32 which connects the upper portions of ridge portions 29 and 30. A ridge 27' (FIGS. 7 and 8), which is the mirror image of ridge 27, is located on the other side 24' of the U-tube. An hour glass shaped section 33 (FIG. 7) is added to the basic U-tube 19 to provide a closure which closes the gap between the upper portions 34 and 35 of legs 20 and 22, respectively, and the upper curved portions 32 and 32' of ridges 27 and 27'.

Figure 1:
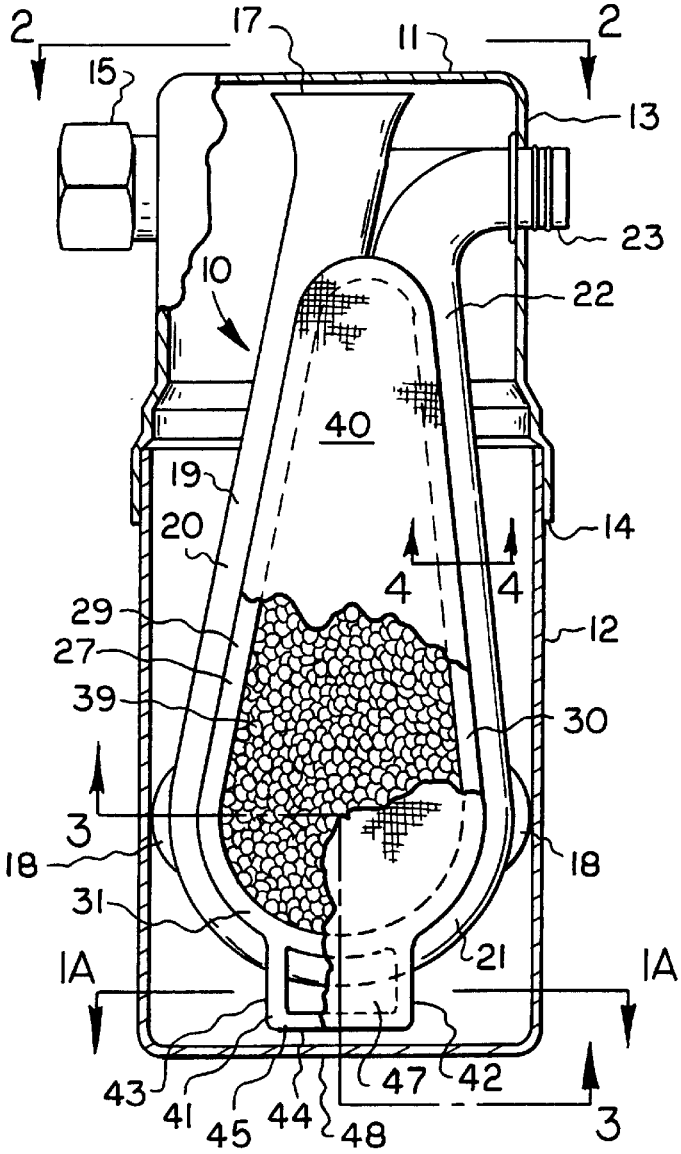
FIG. 1 is a cross sectional view taken substantially along line 1—1 of FIG. 2 with portions broken away and showing the improved integrated U-tube and adsorbent unit mounted in an accumulator of an automotive air conditioning system.

There is a space 37 (FIG. 6) between U-tube return bend 21, legs 20 and 22, and hour glass member 33. This space is filled with adsorbent 39 (FIG. 1) which is preferably molecular sieve, but may be of any other suitable type such as silica gel. Permeable covers 40 and 40' (FIGS. 1 and 3), which are preferably web-bonded polyester felt and which are of the same shape as ridges 27 and 27', respectively, are preferably heat-fused along their outer edges to ridges 27 and 27', respectively, or they may be bonded to ridges 27 and 27' by ultrasonic welding or vibration welding any other suitable bonding means which may include, without limitation, any other type of fusion or the use of bonding cement or any other suitable means of attachment. Permeable covers 40 and 40' may be fabricated out of any other suitable material. While it is preferable to have both covers permeable, it will be appreciated that only one permeable cover may be used. The other cover may be impermeable material which is bonded to the side of the U-tube or it may be a plate which is molded integrally with or otherwise attached to the U-tube.

In FIG. 5, an alternate bonding connection is shown for securing the edge of the cover to the ridge. In this respect, cover 140, which is analogous to cover 40, rests on the surface 60 of ridge 127, which is analogous to ridge 27. A tab 61 which projects from the edge of ridge 127 is rolled over onto the edge of cover 140, and thereafter bonding is effected by any suitable method, such as vibration welding, sonic welding, heat and pressure welding, or any other suitable type of welding or attachment.

The space within the legs 20 and 22 may effectively be enlarged to contain a desired amount of adsorbent by increasing the height of one or both ridges 27 and 27'. Also, if the space within the legs 20 and 22 and return bend 21 is too large for the desired amount of adsorbent, a partition 36, which is shown in phantom lines in FIG. 6, can be installed between the inner sides of legs 20 and 22 in sealing relationship therewith, and the space for adsorbent would be defined by the legs 20 and 22, the partition and the return bend 21, or the space would be defined by the legs 20 and 22 and the partition and the hour glass section 33. It will be appreciated that the outer edges of partition 36 will lie in the same planes as the outer surfaces of ridges 27 and 27' to which the covers are bonded. The partition would be placed at any desired area, as determined by the volume required for the adsorbent. Preferably, the adsorbent is placed in the space immediately above the U-bend. It will be appreciated that if the adsorbent is placed in the space above or below the partition, the permeable cover need only be bonded to the portions of the ridge 27 or 27' and the partition 36 which surround the space in which the adsorbent is contained.

Figure 1A:
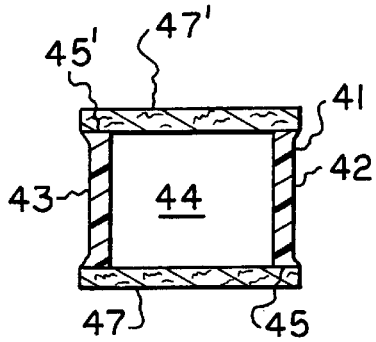
FIG. 1A is a cross sectional view taken substantially along line 1A—1A of FIG. 1 with the accumulator housing omitted.

As noted above, the underside of U-bend 21 includes an oil-receiving hole 26 (FIG. 6). In accordance with another aspect of the present invention, a frame 41 (FIGS. 1, 3, 6 and 8) is molded integrally with U-tube 19. Frame 41 includes sides 42 and 43 and a bottom 44. Sides 42 and 43 and bottom 44 terminate at U-shaped mirror-image edges 45 and 45' (FIGS. 1A, 6 and 8) which lie in the same planes as the outer edges of ridges 27 and 27', respectively. Thus, the permeable covers 40 and 40' are extended to provide covers 47 and 47', respectively, which are bonded to the edges 45 and 45', respectively, of frame 41 by the same means as covers 40 and 40' are bonded to ridges 27 and 27', respectively. Thus, covers 47 and 47' serve as filters to filter the oil at the bottom of accumulator 11 which passes into the space within frame 41 and thereafter enters oil-receiving hole 26. As noted above relative to covers 40 and 40', both covers 47 and 47' need not be permeable, as only one permeable cover 47 or 47' may be adequate for filtration. Also, instead of using permeable fabric on frame 41, metal or plastic filter mesh or screening may be bonded to one or both sides of frame 41. Also, frame 41 need not be limited to the specific shape shown but may be shaped otherwise. While the bottom of frame 41 is shown spaced from the bottom of portion 12 of the accumulator housing 11, frame portion 44 may rest on bottom 48 to stabilize the U-tube.

Figure 9:
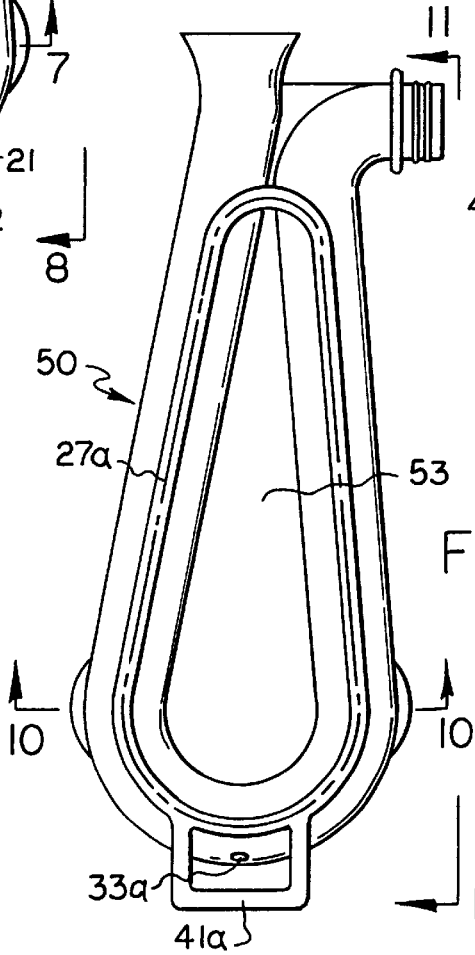
FIG. 9 is a side elevational view of another U-bend construction which can be integrated with an adsorbent unit.
Figure 10:
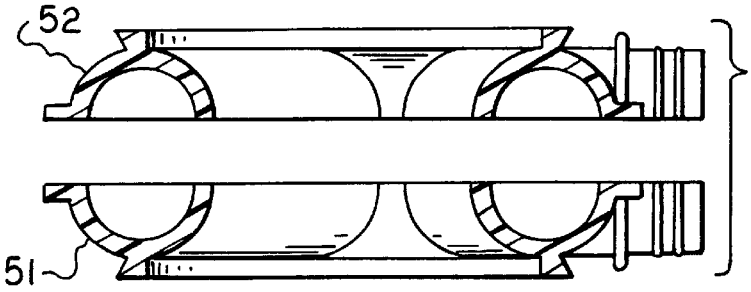
FIG. 10 is a cross sectional view taken substantially along line 10—10 of FIG. 9 and showing the halves of the U-tube separated.
Figure 11:
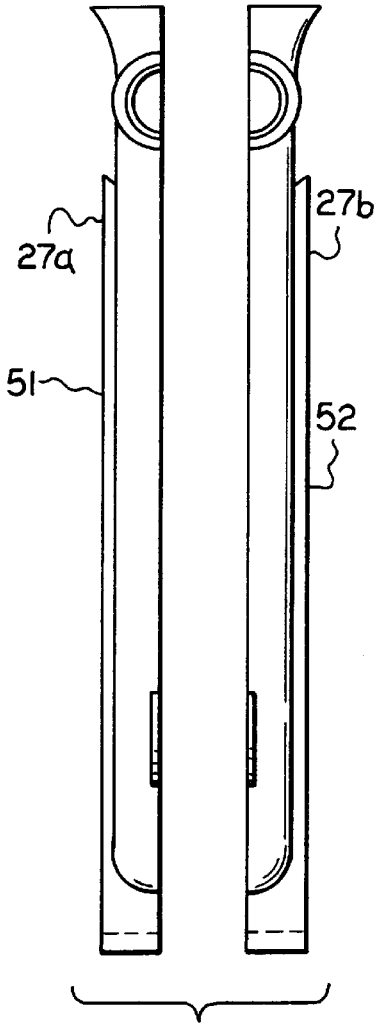
FIG. 11 is a view taken substantially in the direction of arrows 11—11 of FIG. 9 and showing the halves of the U-tube separated.

In FIGS. 9, 10 and 11 another embodiment of a U-tube 50 is disclosed which can be a part of an integrated U-tube and adsorbent unit, such as described above relative to FIGS. 1-8. The U-tube 50 is fabricated by injection molding in two halves 51 and 52 (FIGS. 10 and 11), and thereafter the two halves are bonded to each other by any suitable means including but not limited to vibration welding, fusion welding, ultrasonic welding or gluing. The material of U-tube 50 may be polypropylene or any other suitable resin. Aside from the fact that U-tube 50 is formed from two halves which are bonded to each other, U-tube 50 contains all of the specific structure described above relative to the U-tube 19 of FIGS. 6–8. It is used in the same manner with the placement of the adsorbent in a space 53 and the use of covers which are bonded to ridges 27*a* and 27*b* which are analogous to ridges 27 and 27', respectively, of FIGS. 6–8. It also includes a frame 41*a* which is identical to frame 41 of FIGS. 6–8 and which is utilized in the same manner. Also, the two halves 51 and 52 provide a filter hole 26*a* which is analogous to filter hole 26 of FIGS. 6–8.

Figure 15:
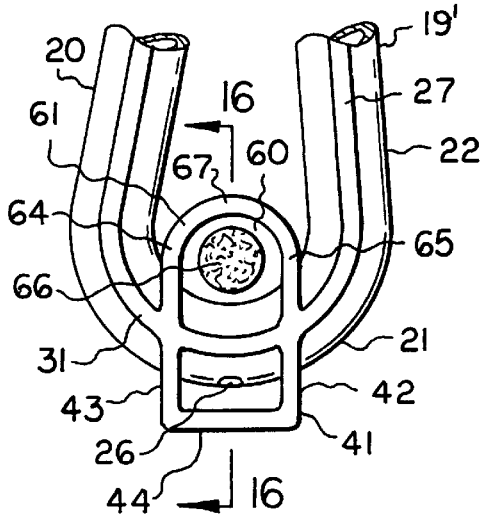
FIG. 15 is a fragmentary side elevational view of a return bend of a U-tube which mounts a separate compartment for a refrigerant tracer dye.
Figure 16:
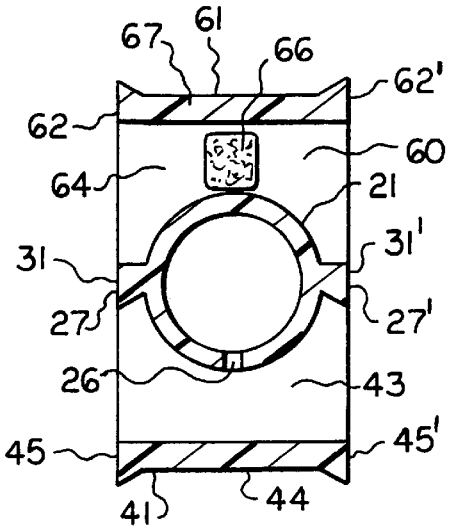
FIG. 16 is a fragmentary cross sectional view taken substantially along line 16—16 of FIG. 15.

In FIGS. 15 and 16 a U-tube 19' is shown which includes a compartment 60 for containing a refrigerant tracer dye 66 which is in the form of a wafer but can be in granular form or in any other suitable form. Compartment 60 is outlined by a frame 61 which has outer edges 62 and 62' which lie in the same plane as the outer edges 45 and 45' of frame 41 and the outer edges of ridge portions 31 and 31' of ridges 27 and 27', respectively. Frame 61 includes substantially vertical portions 64 and 65 which are connected by rounded upper portion 67. Since the edge 62 of frame 61 and edge 45 of frame 41 and the edge of ridge 27 all lie in the same plane, the covers 40 will be bonded to the aforementioned coplanar outer surfaces. An analogous relationship exists with cover 40' relative to edges 62', 45' and the edge of ridge 27'.

It will be appreciated that while the U-tube of FIGS. 15 and 16 shows both frames 41 and 61 along with the ridges 27 and 27', it will be appreciated that each of the foregoing components can be incorporated separately with a U-tube. In this respect, it will be appreciated that a U-tube may have only ridges 27 and 27' if the filtering and die tracer functions are not desired. Also, a U-tube may have only a frame, such as 41, having opposite outer edges, such as 45 and 45' if only a filtering function is desired. Also, a U-tube may have incorporated therein only a frame, such as 61, for containing a refrigerant tracer dye. In this respect, the tracer dye, whether it is in wafer or granular form, can be inserted into compartment 60 defined by frame 61 after one side of frame 61 has been covered and before the opposite side of frame 61 has been covered. The covers for frame 61 are preferably portions of covers 40 and 40', as discussed above. However, in an embodiment of a U-tube wherein a frame, such as 61 is used by itself, separate porous covers can be bonded to one or both opposite sides of frame 61. While porous covers, such as 40 and 40', have not been shown in the embodiment of FIGS. 15 and 16, it will be understood that such covers, as discussed relative to FIGS. 1–4, are used in the embodiment of FIGS. 15 and 16.

Figure 12:
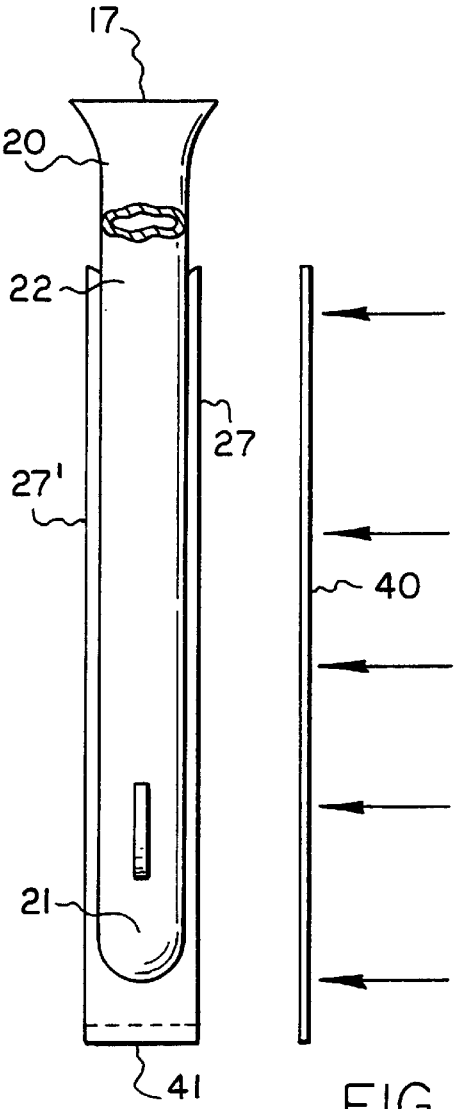
FIG. 12 is a schematic view showing the first step of the method of fabricating an integrated U-tube and adsorbent unit by bonding a cover to one side of the U-tube.
Figure 13:
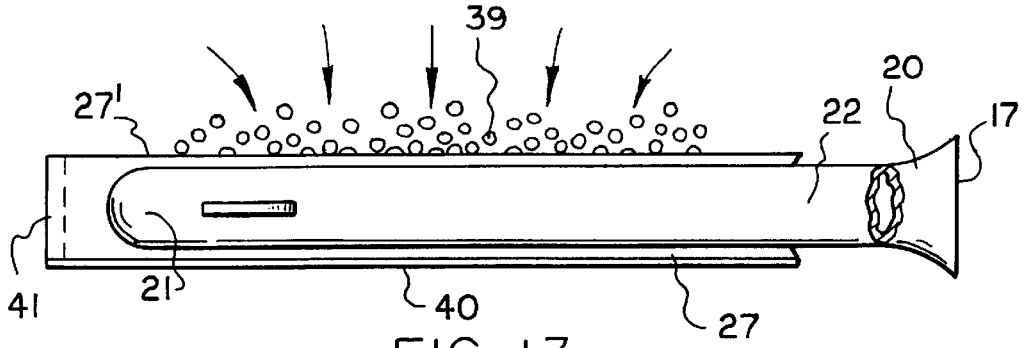
FIG. 13 is a schematic view showing a subsequent step in fabricating an integrated U-tube and adsorbent unit by filling the space between the U-tube's legs with adsorbent.
Figure 14:
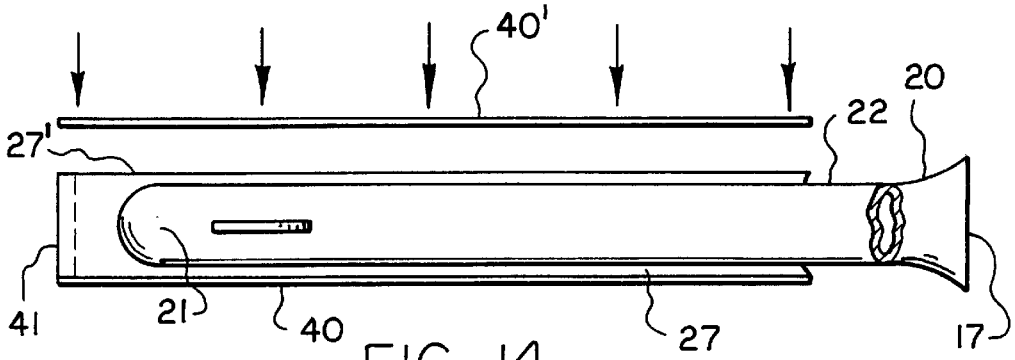
FIG. 14 is a schematic view showing the last step of fabricating an integrated U-tube and adsorbent unit by bonding a cover to the open side of the U-tube to confine the adsorbent between the legs of the U-tube.

In FIGS. 12–14 the method of fabricating the integrated U-tube and adsorbent unit 10 is shown. The first step is to bond cover 40 to ridge 27 by the application of suitable heat and pressure or by ultrasonic welding or by gluing them together or by any other suitable means of attachment. The second step is shown in FIG. 13 wherein the adsorbent unit is dumped into the space between legs 20 and 22. The third step is to seal the cover 40' to ridge 27' by suitable heat and pressure or by ultrasonic welding or by any other suitable means to thereby confine the adsorbent 39 between the legs 20 and 22 and return bend 21.

While the above description has been limited to a plastic U-tube, it will be appreciated that a metal U-tube can also be used if the covers, such as 40 and 40', are suitably bonded thereto, as by gluing or by any other suitable means.

Figure 6A:
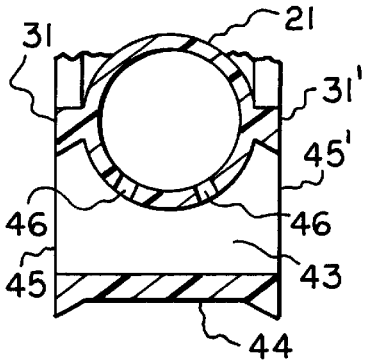
FIG. 6A is a fragmentary cross sectional view taken substantially along line 6A—6A of FIG. 6 and showing an alternate arrangement of hole placement in the return bend.

While only one opening 26 at the lowermost underside of U-bend 21 has been shown in the embodiment of FIGS. 1–7, it will be appreciated that a plurality of openings 46 can be provided as shown in FIG. 6A or in any other suitable manner.

In the above description, primed numerals represent mirror-image counterparts of unprimed numerals.

The above description has used the terminology U-tube. However, the U-tube 19 is sometimes referred to as a J-tube. It is to be understood the terminology U-tube is intended to mean any tube arrangement having spaced legs connected by a return bend such that there is a space between the legs.

In FIGS. 17–23 a modified form of integrated U-tube and adsorbent unit is shown. The adsorbent unit 70 includes a cover 71 consisting of sides 72 and 73 fabricated of web-bonded porous polyester fabric which have been sealed to each other at fused edge 74 which consists of straight portions 75 and 77 and curved portions 79 and 80. The cover 71 is filled with a suitable adsorbent 81, which is the same as adsorbent 39 described above.

The adsorbent unit 70 is integrated onto U-tube 82 which is formed of blow-molded polyethylene plastic. U-tube 82 it has the shape of the U-tube 19 described in detail above in FIGS. 1–8 except that U-tube 82 is not shown with the filter frame 41. More specifically, the U-tube 82 includes straight pipes or legs 83 and 84 connected by U-bend 85. It also has ears which may be identical to ears 18 described above. A ridge 87 is molded integrally with straight pipes 83 and 84 and U-bend 85. Ridge 87 includes straight portions 89 and 90 connected by curved portions 91 and 92.

Figure 21:
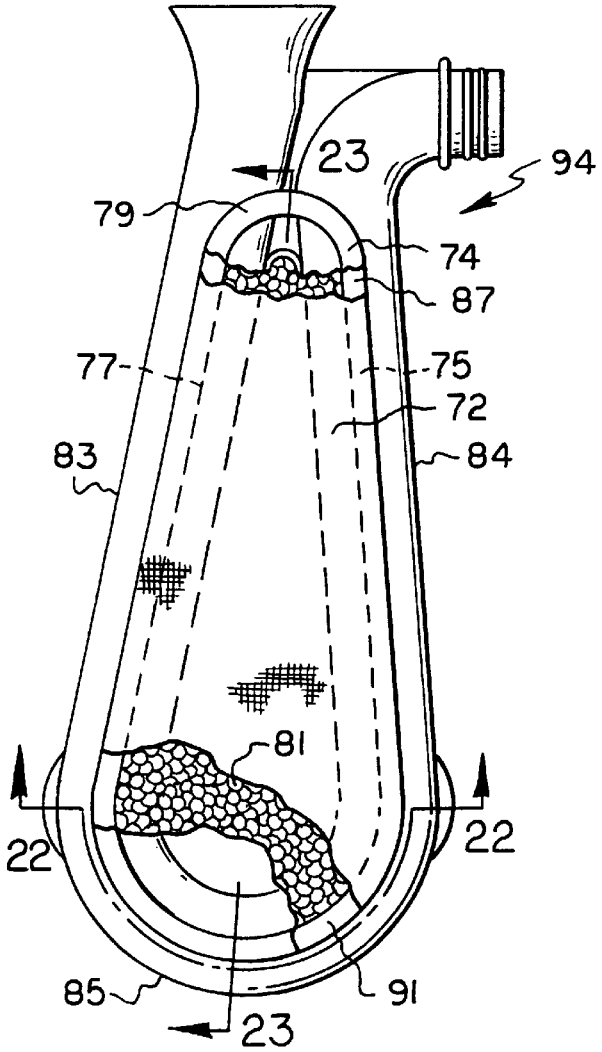
FIG. 21 is a side elevational view, partially broken away, showing the adsorbent unit of FIGS. 17 and 18 integrated onto the U-tube of FIGS. 19 and 20.
Figure 23:
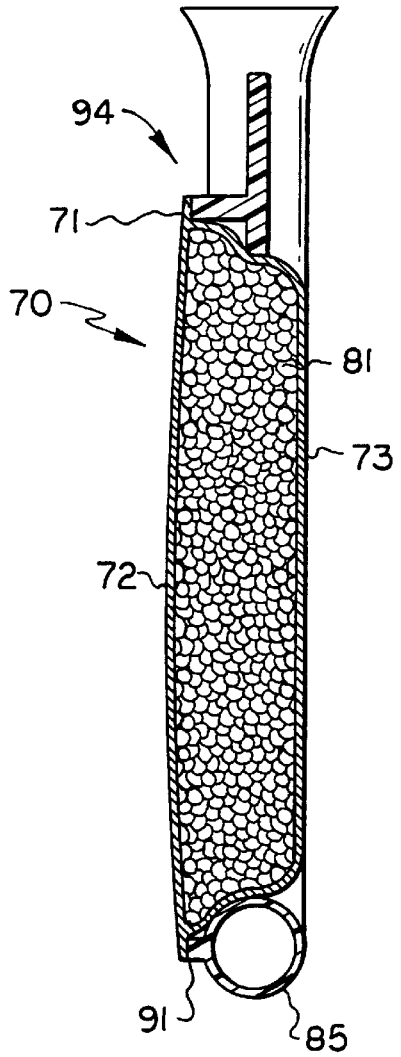
FIG. 23 is a cross sectional view taken substantially along line 23—23 of FIG. 21.
Figure 22:
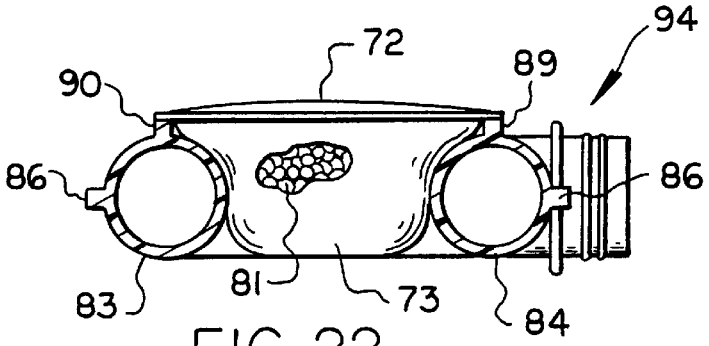
FIG. 22 is a cross sectional view taken substantially along line 22—22 of FIG. 21.

The integrated U-tube and adsorbent unit 94 is shown in FIGS. 21–23. The fused edge 74 of adsorbent cover 70 is fused to ridge 87 by any suitable fusing method as described above wherein the plastic fused edge 74 of adsorbent container 70 is bonded by fusion to ridge 87 of the U-tube 82. The bonding by fusion can be by any of the methods noted above, namely, by heat fusion, ultrasonic welding, vibration welding or any other type of fusion or the use of bonding cement or any other suitable means of attachment.

In the fully integrated position, adsorbent unit 70 occupies the position shown in FIGS. 21–23 wherein the side 73 of the cover 71 is substantially aligned with the outer edges of tubes 83 and 84, and the body of the adsorbent unit is located within the legs 83 and 84 and return bend 85 of the U-tube 82, as shown in FIGS. 22 and 23. The side 73 of cover 71 will generally occupy the positions shown in FIGS. 21–23. If there is a requirement for more adsorbent than can be fitted into the confines of cover sides 72 and 73, sides 72 or 73 can be extended so as to project outwardly beyond the periphery of the U-tube. In this respect, side 73 could project outwardly to the right in FIG. 23 and side 72 can project outwardly to the left beyond its position shown in FIG. 23.

While the U-tube 82 has been shown with a ridge 87 thereon, it will be appreciated that the edge 74 of an adsorbent cover could be fused directly to the U-tube if it does not have a ridge 87. It will be appreciated that the cover 71 can be extended beyond that shown, if desired, for bonding to the U-tube.

The construction of the adsorbent unit 70 and the U-tube 82, as shown in FIGS. 17 and 23, precludes the incorporation therein of a separate frame for a filter and for a refrigerant tracer, as described above. However, there is no reason that each of the foregoing frames cannot be incorporated into the U-tube 82, if desired. In this respect, the incorporation of a filter frame need not require a change in the configuration of the adsorbent unit 70. However, if a refrigerant tracer frame is incorporated in the manner shown in FIGS. 15 and 16, then the configuration of the adsorbent container would have to be modified accordingly. Alternatively, the refrigerant tracer compartment could be formed so that it extends outwardly from the side of one of the tubes 83 or 84 or the U-bend 85 and the tracer can be contained in such a frame by separate porous covers.

While preferred embodiments of the present invention have been disclosed, it will be appreciated that it is not limited thereto but may be otherwise embodied within the scope of the following claims.

What is claimed is:

1. A U-tube comprising a plurality of molded parts which are bonded to each other to define spaced legs and a return bend having a conduit extending through said spaced legs and said return bend, an oil pick-up hole in said return bend, and a filter-material supporting frame on said return bend proximate said oil pick-up hole.

2. A U-tube as set forth in claim 1 wherein said filter-material supporting frame is molded integrally with said return bend.

3. A U-tube as set forth in claim 2 wherein said filter-material supporting frame comprises a plurality of pivots.

4. A U-tube as set forth in claim 1 wherein said molded parts are located on opposite sides of said conduit.

5. A U-tube as set forth in claim 4 wherein said filter-material supporting frame is molded integrally with said return bend.

6. A U-tube as set forth in claim 5 wherein said filter-material supporting frame comprises a plurality of pivots.

* * * * *